US008505552B1

(12) United States Patent
Soare

(10) Patent No.: US 8,505,552 B1
(45) Date of Patent: Aug. 13, 2013

(54) GOLDEN RATIO EYEBROW OVERLAY DEVICE

(76) Inventor: Anastasia Soare, Beverly Hills, CA (US)

( * ) Notice: Subject to any disclaimer, the term of this patent is extended or adjusted under 35 U.S.C. 154(b) by 0 days.

(21) Appl. No.: 13/492,624

(22) Filed: Jun. 8, 2012

(51) Int. Cl.
*A45D 40/30* (2006.01)

(52) U.S. Cl.
USPC ..... 132/216; 132/319; 434/100

(58) Field of Classification Search
USPC ..... 132/216, 214, 319; 434/100, 94, 434/87, 88
See application file for complete search history.

(56) References Cited

U.S. PATENT DOCUMENTS

2009/0260648 A1* 10/2009 Castelluccio ..... 132/200

* cited by examiner

*Primary Examiner* — Rachel Steitz
(74) *Attorney, Agent, or Firm* — Allan Z. Litovsky; Greenberg Traurig, LLP

(57) ABSTRACT

An overlay is superimposed over an image of a person's face. This overlay has a transparent portion separated from an opaque portion by a vertical edge, a nostril marker on the transparent first portion, and a mark centered along the edge indicating placement of a nose tip centered along the edge. The overlay has a first straight guide line in the transparent portion passing vertically through the nostril marker, a second straight guide line preferably at about a 40° angle from the first line passing through an outer edge of the nostril marker, and a third straight guide line at about a 38° angle from the first line passing through the person's nose tip to provide Golden Ratio orientation for the person's eyebrow. The overlay can be a decal or it may be electronically generated for superposition over an electronic image of a person's face.

20 Claims, 4 Drawing Sheets

GOLDEN RATIO EYEBROW OVERLAY DEVICE

CROSS REFERENCE TO RELATED APPLICATIONS

This application is related to U.S. Pat. No. 8,015,981, issued on Sep. 13, 2011, entitled Stencils and Gauging Device for Aesthetically Pleasing Eyebrow shaping, the content of which is hereby incorporated by reference in its entirety.

BACKGROUND OF THE DISCLOSURE

This disclosure relates to cosmetic devices, and in particular to eyebrow shaping techniques and related devices. The Golden Ratio is often denoted by the Greek letter $\phi$ ('phi'). It expresses a relationship that the sum of two quantities is to the larger quantity as the larger is to the smaller (its numerical approximation is 1.618033989). The Golden Ratio is a proportion universally found in Nature, expressed in the arrangement of branches along the stems of plants, in the placement of the shell spirals in snails, or in the features of the human body. The Golden Ratio is widely believed to be a natural principle related to the laws of equilibrium. Many great artists have proportioned their works according to the Golden Ratio, as it is believed to be aesthetically pleasing. Hence, a "perfect" face would display Golden Ratio proportions such as these: Distance from Top-of-the-head to Chin divided by Width-of-head equals $\phi$; Length-of-Lips divided by Width-of-Nose equals $\phi$; Outside distance between Eyes divided by Length-of-Lips equals $\phi$; etc. It follows that, on a "perfect" face, the high point (HP) of the eyebrow would divide the eyebrow arch at precisely the Golden Ratio point between the starting point of the eyebrow (SP) and the ending point of the eyebrow (EP) (SP-to-HP divided by HP-to-EP=$\phi$).

SUMMARY OF THE DISCLOSURE

One embodiment of a device in accordance with the present disclosure includes an overlay adapted to be superimposed over an image of a person's face. This overlay has a transparent first portion separated from an opaque second portion by a vertical edge, a nostril marker on the transparent first portion, and a mark centered along the edge indicating placement of a nose tip centered along the edge. The overlay has a first straight guide line in the first portion passing vertically through the nostril marker, a second straight guide line in the first portion at an angle from the first line passing through an outer edge of the nostril marker, and a third straight guide line at an angle from the first line and spaced from the second line passing through the mark indicating the nose tip.

The angle between the first guide line and the second guide line may be determined for each individual following the method described in Paragraph 15 below. Likewise, the angle between the first guide line and the third guide line may be determined for each individual following the method described in Paragraph 15 below. Alternatively, the lines and angles may be determined according to other methods or variations of the method outlined in Paragraph 15 below. The overlay may be an electronic image overlay on an electronic display device, such as a cell phone display, a tablet computer, a laptop, a desktop personal computer display or any other display. Alternatively, the overlay may be a sheet made of plastic or another suitable material that can be removably attached to or otherwise displayed on a mirror surface, such as a makeup mirror. The overlay may come with the vertical line already drawn on it. The position of the other two lines may be determined according to the each individual's facial proportions. The method by which these two angled lines would be drawn may vary. In one embodiment, they may drawn with a black sharpie directly onto the overlay. In another embodiment, one may determine what the angles are and input the corresponding values into an application running on a computing device. Yet in another embodiment, one may use lines, strips or strings movably attached to the overlay or a similar arrangement.

One embodiment of the device in accordance with the present disclosure may include a first and a second overlay each adapted to be superimposed over an image of a person's face. In this embodiment, each of the overlays has a transparent first portion separated from an opaque second portion by a vertical edge, a nostril marker on the transparent first portion; and a mark indicating placement of a nose tip centered along the edge, a first straight guide line in the first portion passing vertically through the nostril marker, a second straight guide line in the first portion at an angle from the first line passing through an outer edge of the nostril marker, and a third straight guide line at an angle from the first line and spaced from the second line passing through the mark indicating the nose tip.

In such an embodiment the transparent portion of the first overlay is on the left of the second portion so that a right half of the image of the person's face is hidden when the first overlay is superimposed over the image of the person's face. The transparent portion of the second overlay is on the right of the second portion so that a left half of the image of the person's face is hidden when the second overlay is superimposed over the image of the person's face.

The angle between the first guide line and the second guide line may be determined for each individual following the method described in Paragraph 15 below. Likewise, the angle between the first guide line and the third guide line may be determined for each individual following the method described in Paragraph 15 below. Alternatively, the lines and angles may be determined according to other methods or variations of the method outlined in Paragraph 15 below. The overlay may be an electronic image overlay on a display device or it may be a plastic sheet that can be removably attached to a mirror surface.

An embodiment in accordance with this disclosure includes a first and a second overlay each adapted to be superimposed over an image of a person's face. Each of the overlays has a transparent first portion separated from an opaque second portion by a vertical edge, a nostril marker on the transparent first portion; and a mark indicating placement of a nose tip centered along the edge. The overlay transparent portion has a first straight guide line in the first portion passing vertically through the nostril marker, a second straight guide line in the first portion at an acute angle from the first line passing through an outer edge of the nostril marker, and a third straight guide line at an acute angle from the first line and spaced from the second line passing through the mark indicating the nose tip. The transparent portion of the first overlay is on the left of the second portion so that a right half of the image of the person's face is hidden when the first overlay is superimposed over the image.

The transparent portion of the second overlay is on the right of the second portion so that a left half of the image of the person's face is hidden when the second overlay is superimposed over the image. The locations and orientations of the first guide line and second guide line in each of the overlays may be determined pursuant to the method described in Paragraph 15 below or a similar method that may be understood by those skilled in the art.

Further features, advantages and characteristics of the embodiments of this disclosure will be apparent from reading the following detailed description when taken in conjunction with the drawing figures.

DETAILED DESCRIPTION

When the starting point (SP) of a person's eyebrow is on an imaginary guide line (IGL1) running vertically through the middle of the respective nostril, the end point of that eyebrow (EP) on a second imaginary guide line (IGL2) running from the outer edge of the nostril through the outside end of the respective eye and the eyebrow high point (HP) is located on an intermediate imaginary guide line (IGL3) extending from the center of the nose through the iris at the center of the eye, there is an optimal match between the eyebrows and the other facial features. Although such a placement of the high point (HP) will typically be at the Golden Ratio only for a "perfect" face, such an eyebrow placement will also result in an aesthetically pleasing adjustment to a person's face when facial proportions are less than "perfect". The guidance overlay device in accordance with the present disclosure, shown in FIGS. 1-4 contains a set of lines that closely approximates the IGL1/IGL2/IGL3 described above.

Figure 1:
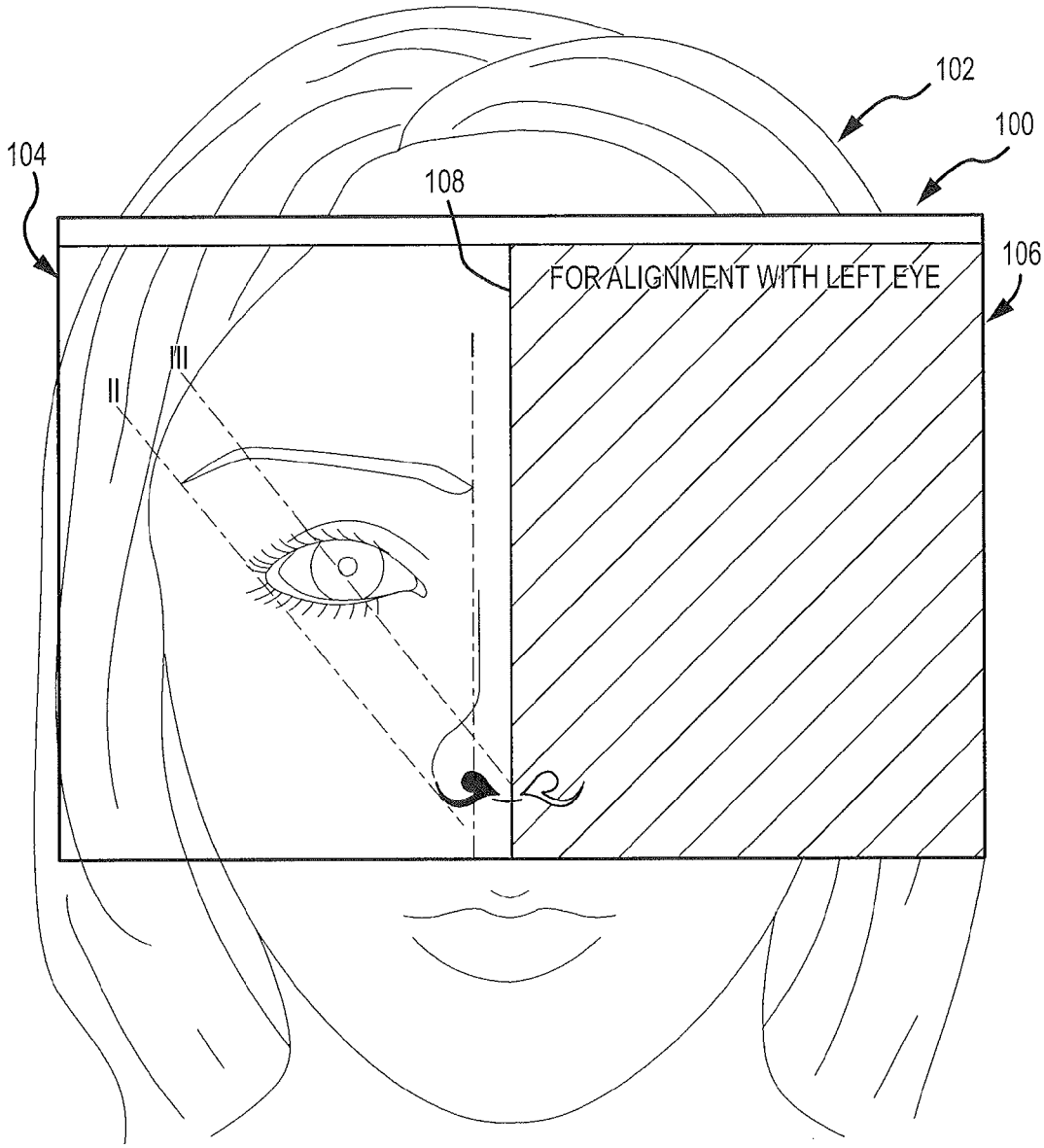
FIG. 1 shows a right eyebrow alignment overlay device in accordance with the present disclosure over an image, such as in a mirror, or on an iPad, of a person's face.
Figure 3:
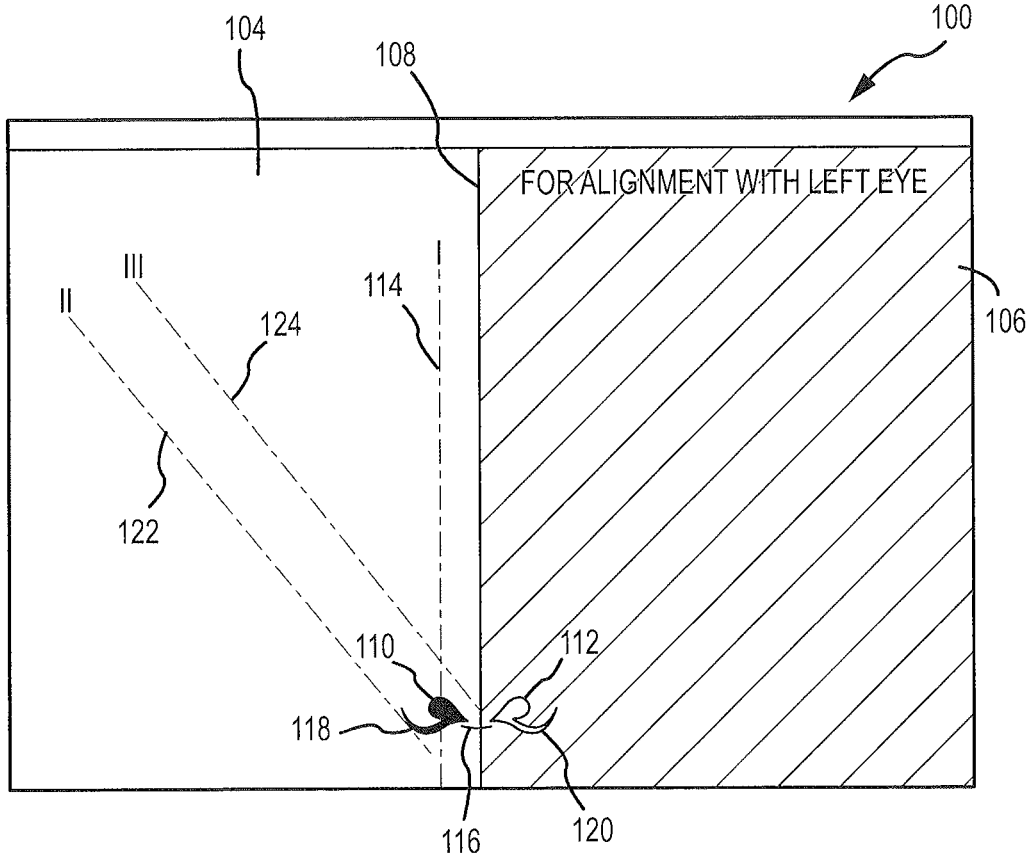
FIG. 3 is a separate view of the right eyebrow alignment overlay device shown in FIG. 1.
Figure 4:
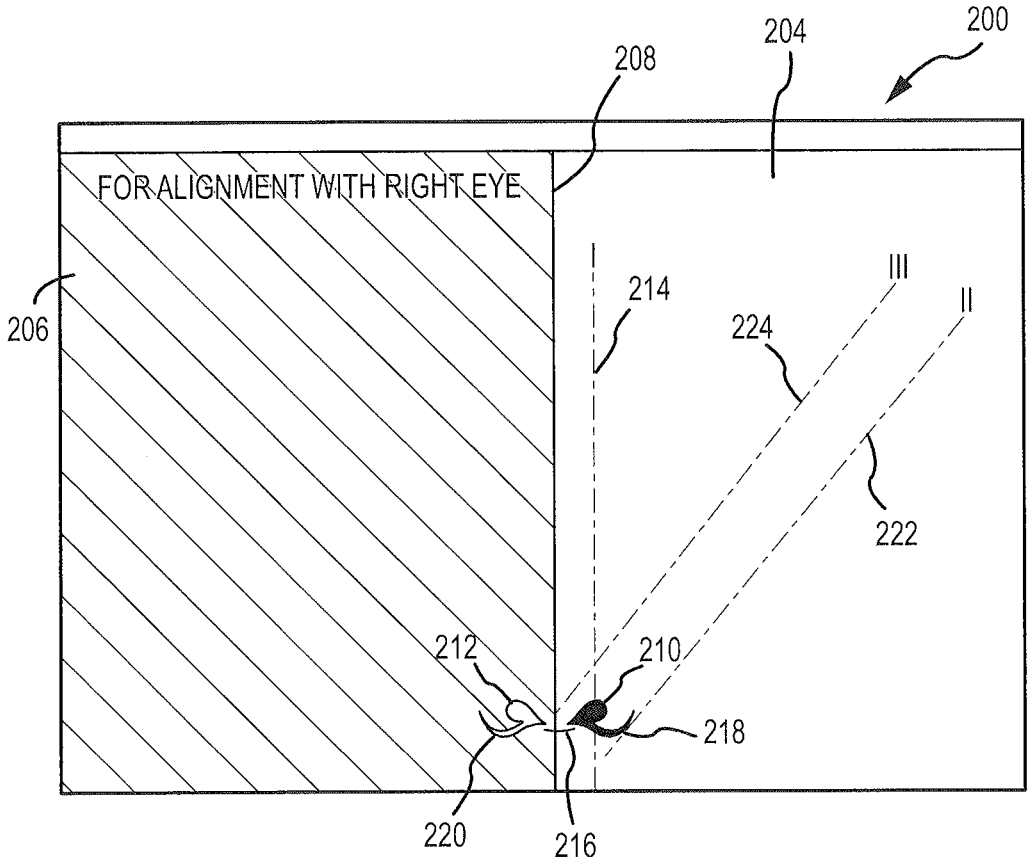
FIG. 4 is a separate view of the left eyebrow alignment overlay device shown in FIG. 2.

Embodiments in accordance with the present disclosure enable even a relatively unskilled person to quickly and accurately determine the location and shape of her eyebrows according to the Golden Ratio standard. One exemplary embodiment of the present disclosure is a right eyebrow overlay device 100 that is placed over or appears over an image 102 of a person's face as is shown in FIG. 1. The image 102 of the person's face may be reflection in a mirror or it may be a displayed photographic image of the person's face on a display device such as on a laptop display, desktop computer display, tablet computer or cell phone screen. A view as in FIG. 1 of a left eyebrow overlay device 200 is shown over the image 102 of the person's face in FIG. 2. FIGS. 3 and 4 present separate views of devices 100 and 200 respectively.

The device overlay 100 (FIGS. 1 and 3) for a person's left eye includes a first clear or transparent portion 104 separated from an opaque second portion 106. As is best shown in FIG. 3, the first and second portions are separated along a vertical dividing edge 108. An outline of exemplary nostril locators 110 and 112 are outlined on either side and centered on the vertical dividing edge 108 near the bottom of the overlay 100. A nose tip line 116 is centered between the exemplary nostril locators 110 and 112. Exemplary nostril ends 118 and 120 extend outward from each of the nostril locators 110 and 112 respectively.

A vertical dashed guide line (IGLI) 114 is positioned parallel to the vertical edge in the transparent portion 104. This line 114 passes through the center of the exemplary nostril locator 110. A second dashed guide line (IGL2) 122 extends at an acute angle from the guide line 114 along the outer edge of the exemplary nostril end 118. This second dashed line is at an angle of between about 35° and 45°, more preferably between 38° and 42°, and is most preferably is positioned at an angle of about 40° from the vertical guide line 114.

A third guide line (IGL3) 124 extends at an acute angle from the guide line 114 through the very tip of the exemplary nose, which is marked by the intersection of the third guide line 124 with the edge 108 and which would be spaced above the nose tip line 116 by about 0.2-0.3 inches. This third guide line is at an angle of between about 33° and 43°, more preferably between about 36° and 40°, and most preferably about 38° from the vertical guide line 114.

Figure 2:
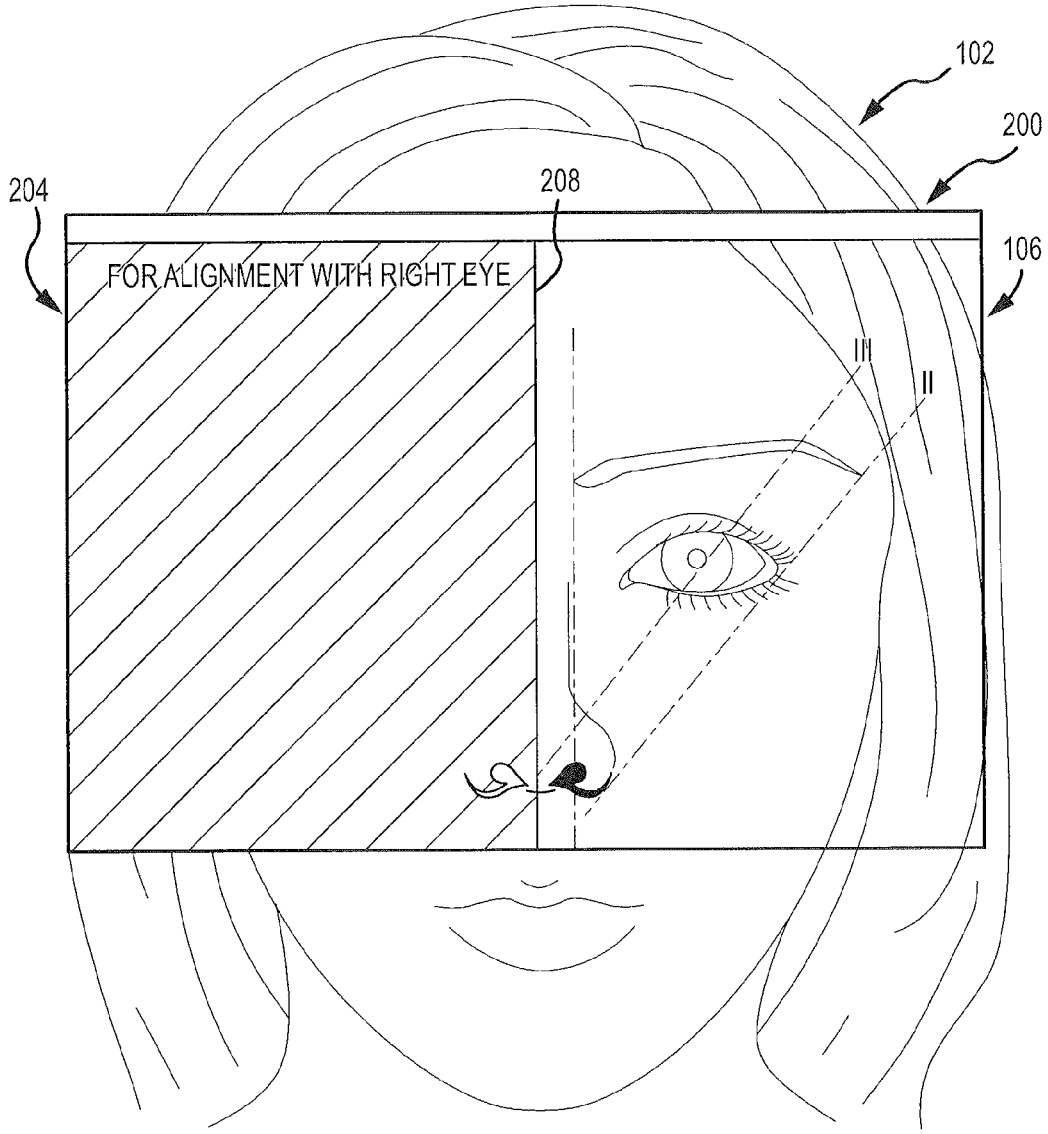
FIG. 2 shows a left eyebrow alignment overlay device in accordance with the present disclosure over the image of the person's face shown in FIG. 1.

An exemplary device overlay 200 for a person's right eye is shown in FIGS. 2 and 4. The device overlay 200 (FIGS. 2 and 4) for a person's right eye includes a first clear or transparent portion 204 separated from an opaque second portion 206. As is best shown in FIG. 4, the first and second portions are separated along a vertical dividing edge 208. An outline of exemplary nostril locators 210 and 212 are outlined on either side and centered on the vertical dividing edge 208 near the bottom of the overlay 200. A nose tip line 216 is centered between the exemplary nostril locators 210 and 212. Exemplary nostril ends 218 and 220 extend outward from each of the nostril locators 210 and 212 respectively.

A vertical dashed guide line (IGLI) 214 is positioned parallel to the vertical edge in the transparent portion 204. This line 214 passes through the center of the exemplary nostril locator 210. A second dashed guide line (IGL2) 222 extends at an acute angle from the guide line 214 along the outer edge of the exemplary nostril end 218. This second dashed line is at an angle of between about 35° and 45°, more preferably between 38° and 42°, and is most preferably is positioned at an angle of about 40° from the vertical guide line 214.

A third guide line (IGL3) 224 extends at an acute angle from the guide line 214 through the very tip of the exemplary nose, which is marked by the intersection of the third guide line 224 with the edge 208 and would generally be spaced above the nose tip line 216 by about 0.2-0.3 inches. This third guide line is at an angle of between about 33° and 43°, more preferably between about 36° and 40°, and most preferably about 38° from the vertical guide line 214.

As can readily be seen by comparing overlays 100 and 200, they are essentially mirror images of each other. The overlays 100 and 200 may be actual mylar or other plastic decals which can be placed on a mirror or other reflective surface. Alternatively they each may be an electronic image overlay generated in computer software, and then displayed over a camera image such as is often found today in tablet computers and cell phones.

A person then positions her image relative to the overlay such that her nostrils align with the overlay nostrils 110 and 112 or 210 and 212. The person can move her head back and forth until a position most closely matching the Golden Ratio is achieved and then can adjust her eyebrow makeup accordingly.

The guide lines 114, 214 indicate to the person where her eyebrow should begin. The guide lines 122 and 222 should closely pass from the person's side of the nostril past the person's outer edge of her eye, and will show the ideal end point of the eyebrow as is shown in FIGS. 1 and 2. The guide lines 124 and 224 should ideally pass from the person's nose tip through the person's iris and intersect the highest point of her eyebrow, as shown in FIGS. 1 and 2 such that the proportions of the person's eyebrow correspond to the Golden Ratio.

These guide lines help the person to shape and outline her eyebrows closely to achieve the Golden Ratio.

One preferred embodiment of the left eye overlay device is a rectangular sheet of transparent plastic sheet having a dimension of about 6"×9". The right half of the sheet is opaque. An outline of a person's nostrils is printed on the sheet as above described, centered on the left edge of the right half of the sheet. The right eye overlay device is a mirror image of the left eye overlay device. The sheets may have a slight self adhesive backing similar to that on a sticky note, so as to be removably affixed to a makeup mirror. The opaque portion is preferably opaque black or other dark color. The opaque black facilitates an easy sight of the guide lines IGL1, IGL2 and IGL3, and tends to prevent the person from squinting.

The method for use of the right overlay 200 is the same for the left overlay 100. The overlay, if a decal, is placed (by way of its self-adherent backing) upright on a mirror of your choice, with IGL1 in a vertical position. The IGL's are now visible in the mirror and when one places his/her face over that spot in the mirror, one should be able to see the IGL's as if they were drawn on his/her face. Slight adjustment of the head in relation to the mirror should cause the IGL's to closely align with the SP/HP/EP on the respective eyebrow. IGL1 aligns vertically through the middle of the nostril, and marks the SP on the eyebrow; IGL2 starts from the side of the nostril in a diagonal direction, touching the outside corner of the eye, and it marks the EP on the eyebrow; IGL3 runs from the tip of the nose diagonally through the center of the iris, to define the HP on the eyebrow.

The overlay can be used either to originally determine the SP/HP/EP prior to shaping the eyebrow, or it can be used as a guideline to finesse the eyebrow shaping and placing of the SP/HP/EP following the use of other Golden Ratio eyebrow-shaping techniques, such as the use of the GRS described in my U.S. Pat. No. 8,015,981. The overlay can be a physical decal or template, or it may be electronically generated for superposition over an electronic image of a person's face on a computer display.

All such changes, alternatives and equivalents in accordance with the features and benefits described herein, are within the scope of the present disclosure. Such changes and alternatives may be introduced without departing from the spirit and broad scope of my invention as defined by the claims below and their equivalents.

What is claimed is:

1. A device comprising:

an overlay adapted to be superimposed over an image of a person's face;

the overlay having a transparent first portion separated from an opaque second portion by a vertical edge, a nostril marker on the transparent first portion, and a mark indicating placement of a nose tip centered along the edge;

a first straight guide line in the first portion passing vertically through the nostril marker;

a second straight guide line in the first portion at an angle from the first line passing through an outer edge of the nostril marker; and a third straight guide line at an angle from the first line and spaced from the second line passing through the mark indicating the nose tip.

2. The device according to claim 1 wherein the angle between the first guide line and the second guide line is about 40 degrees.

3. The device according to claim 2 wherein the angle between the first guide line and the third guide line is about 38 degrees.

4. The device according to claim 1 wherein the angle between the first guide line and the third guide line is about 38 degrees.

5. The device according to claim 1 wherein the overlay is an electronic image overlay on an electronic display device.

6. The device according to claim 1 wherein the overlay is a plastic sheet that can be removably attached to a mirror surface.

7. The device according to claim 5 wherein the electronic display device is selected from the group consisting of a tablet computer, a cell phone, and a personal computer display.

8. A device comprising:

a first and a second overlay each adapted to be superimposed over an image of a person's face;

each of the overlays having a transparent first portion separated from an opaque second portion by a vertical edge, a nostril marker on the transparent first portion; and a mark indicating placement of a nose tip centered along the edge;

a first straight guide line in the first portion passing vertically through the nostril marker;

a second straight guide line in the first portion at an angle from the first line passing through an outer edge of the nostril marker; and a third straight guide line at an angle from the first line and spaced from the second line passing through the mark indicating the nose tip.

9. The device according to claim 8 wherein the transparent portion of the first overlay is on the left of the second portion so that a right half of the image of the person's face is hidden when the first overlay is superimposed over the image.

10. The device according to claim 8 wherein the transparent portion of the second overlay is on the right of the second portion so that a left half of the image of the person's face is hidden when the second overlay is superimposed over the image.

11. The device according to claim 8 wherein the angle between the first guide line and the second guide line is about 40 degrees.

12. The device according to claim 11 wherein the angle between the first guide line and the third guide line is about 38 degrees.

13. The device according to claim 8 wherein the angle between the first guide line and the third guide line is about 38 degrees.

14. The device according to claim 8 wherein each overlay is an electronic image overlay on an electronic display device.

15. The device according to claim 14 wherein the electronic display device is selected from the group consisting of a tablet computer, a cell phone, and a personal computer display.

16. The device according to claim 8 wherein each overlay is a plastic sheet that can be removably attached to a mirror surface.

17. A device comprising:

a first and a second overlay each adapted to be superimposed over an image of a person's face;

each of the overlays having a transparent first portion separated from an opaque second portion by a vertical edge, a nostril marker on the transparent first portion; and a mark indicating placement of a nose tip centered along the edge;

a first straight guide line in the first portion passing vertically through the nostril marker;

a second straight guide line in the first portion at an acute angle from the first line passing through an outer edge of the nostril marker; and a third straight guide line at an acute angle from the first line and spaced from the second line passing through the mark indicating the nose tip.

18. The device according to claim 17 wherein the transparent portion of the first overlay is on the left of the second portion so that a right half of the image of the person's face is hidden when the first overlay is superimposed over the image.

19. The device according to claim 17 wherein the transparent portion of the second overlay is on the right of the second portion so that a left half of the image of the person's face is hidden when the second overlay is superimposed over the image.

20. The device according to claim 17 wherein the second guide line is at an angle of about 40 degrees from the first guide line and the third guide line is at an angle of about 38 degrees from the first guide line.

* * * * *